US006694710B2

(12) United States Patent
Wang

(10) Patent No.: US 6,694,710 B2
(45) Date of Patent: Feb. 24, 2004

(54) VACUUM BAG-SEALING MACHINE

(75) Inventor: Donglei Wang, No. 4 Workshop Building, Pinglanyuan Industrial Zone, Nanping Town, Zhuhai, Guangdong Province (CN), 519060

(73) Assignee: Donglei Wang, Guangdong (CN)

( * ) Notice: Subject to any disclaimer, the term of this patent is extended or adjusted under 35 U.S.C. 154(b) by 0 days.

(21) Appl. No.: 10/313,257

(22) Filed: Dec. 6, 2002

(65) Prior Publication Data

US 2003/0110741 A1 Jun. 19, 2003

(30) Foreign Application Priority Data

Dec. 14, 2001 (CN) ..... 01258685 U
Dec. 14, 2001 (CN) ..... 01258689 U

(51) Int. Cl.[7] ..... B65B 31/00
(52) U.S. Cl. ..... 53/512; 53/87; 53/88; 53/427; 53/432
(58) Field of Search ..... 53/427, 432, 79, 53/87, 88, 510, 512, 477

(56) References Cited

U.S. PATENT DOCUMENTS 2,672,268 A * 3/1954 Bower ..... 53/79
4,177,622 A * 12/1979 Siegel et al. ..... 53/511
4,330,975 A * 5/1982 Kakiuchi ..... 53/79
4,941,310 A * 7/1990 Kristen ..... 53/512
5,048,269 A * 9/1991 Deni ..... 53/512
5,239,808 A * 8/1993 Wells et al. ..... 53/512
5,638,664 A * 6/1997 Levsen et al. ..... 53/512

* cited by examiner

*Primary Examiner*—Eugene Kim
*Assistant Examiner*—Christopher Harmon
(74) *Attorney, Agent, or Firm*—Wallenstein Wagner & Rockey, Ltd.

(57) ABSTRACT

The present invention discloses a vacuum bag sealing machine used for vacuumizing and sealing plastic bag containing food or the like therein so as to keep the food or the like fresh. The vacuum bag sealing machine comprises a main body consisted of a top cover and a base connected pivotally with the top cover; a static sealing unit including an upper and a lower sealing strip which are disposed on the front portion of the main body, the lower sealing strip being provided with a predetermined number of through holes; a vacuum generating unit including a vacuum pump and an exhaust tubule mounted on the base, the vacuum pump being communicated with the predetermined number of through holes formed in the lower sealing strip through the exhaust tubule; and a heating and opening-sealing unit. The vacuum bag sealing machine is improved in the static sealing unit and the vacuum generating unit, so that it has an increased sealing reliability and a quickened vacuumizing speed.

5 Claims, 6 Drawing Sheets

VACUUM BAG-SEALING MACHINE

TECHNICAL FIELD OF THE INVENTION

The present invention relates to a vacuum bag sealing machine using for vaccumizing and sealing a plastic bag containing food or the like therein.

BACKGROUND ART OF THE INVENTION

Presently, a vacuum bag sealing machine being widely used typically vacuumizes a bag via a suction nozzle or a vacuum chamber. In the case of using a vacuum chamber, the interior space of the vacuum chamber is large and the air quantity to be pumped is big, so that the speed and efficiency of bag sealing is low. On the other hand, with a suction nozzle, the sealing effect is unfavorable and a desired vacuity is difficult to be achieved. Moreover, since a joint of the suction nozzle with a rubber hose is often moved, the rubber hose tends to be worn out. The rubber hose has elasticity and the position at which the rubber hose is placed is variable, so that the sealing is irregular and the reliability thereof is low. Also, the rubber hose is flexible, so that it is easy to be shriveled, thus deteriorating the fluidity of the air. In addition, in order to prevent water and dust from entering interior of the vacuum pump, the suction nozzle needs to be provided with a filter screen.

SUMMARY OF THE INVENTION

Accordingly, an object of the present invention is to provide a vacuum bag sealing machine improved in vacuumizing mode, which has an increased sealing reliability, higher sealing speed, and can be operated easily.

The object of the present invention is accomplished by providing a vacuum bag sealing machine comprising a main body consisted of a top cover and a base, the top cover and the base being connected with each other via a pivotal shaft; a static sealing unit including an upper sealing strip and a lower sealing strip which are disposed on the front portion of the main body, the lower sealing strip being provided with a predetermined number of through holes; a vacuum generating unit including a vacuum pump and an exhaust tubule mounted on the base, the vacuum pump being communicated with the through holes formed in the lower sealing strip through the exhaust tubule; and a heating and opening-sealing unit.

In one preferred embodiment of the present invention, the vacuum generating unit further comprises an air guide groove formed between the lower sealing strip and the base, the lower sealing strip is formed with a plurality of through holes, and the exhaust tubule connected to the vacuum pump is communicated with the plurality of through holes of the lower sealing strip through the air guide groove.

Preferably, the upper sealing strip of the static sealing unit is fixed in the top cover and has a flat bottom surface, the lower sealing strip is fixed on the base at a position corresponding to the upper sealing strip and has a flat top surface, the plurality of through holes are elongated through holes perpendicular to the top surface of the lower sealing strip.

The plurality of through holes formed in the lower sealing strip are elongated through holes arranged parallel to each other.

The air guide groove formed between the bottom surface of the lower sealing strip and the base is communicated with the plurality of elongated through holes arranged parallel to each other, the exhaust tubule is positioned at one end of the bottom portion of the air guide groove, an electromagnetic valve is mounted on the other end thereof, and an air guide pipe is provided under the lower end of the electromagnetic valve.

The exhaust tubule and a pressure switch are connected with an inlet end of the vacuum pump through the rubber hose, the main body is provided with a start switch used for starting the vacuum pump on a side surface thereof.

The heating and opening-sealing unit comprises heating wires disposed on the base outside the lower sealing strip.

In another preferred embodiment of the present invention, the static sealing unit comprises an upper sealing strip and a lower sealing strip; the vacuum generating unit comprises an air guide support positioned between the upper sealing strip and the lower sealing strip, the air guide support has an exhaust hole extended by being perpendicular to the top surface and the bottom surface thereof; the exhaust tubule connected with the vacuum pump is communicated with the exhaust hole via the through hole formed in the lower sealing strip.

The air guide support is a flattened barrel in shape and connected to a mounting rack on the base via a hinge, and can rotate around the hinge. The exhaust hole is formed in the central portion of the air guide support, and the exhaust tubule is mounted on the base under the exhaust hole.

The upper end face of the exhaust tubule is higher than the surface of the base therearound.

The upper sealing strip of the static sealing unit is fixed in the top cover, a first recess is provided in a bottom portion of the upper sealing strip, the profile of the first recess is adaptive to that of the upper portion of the air guide support, a second recess is provided in a top portion of the lower sealing strip, the profile of the second recess is adaptive to that of the lower portion of the air guide support, the through hole is formed in the second recess of the lower sealing strip at a position corresponding to the exhaust hole, and communicated with the exhaust tubule on the base.

The exhaust tubule and a pressure switch are connected with an inlet end of the vacuum pump via a rubber hose.

The heating and opening-sealing unit comprises heating wires disposed on the base outside the lower sealing strip.

The present invention employs a novel static sealing unit and a vacuum generating unit, so that the sealing reliability and the working efficiency thereof are increased and the operation is easy and convenient.

BRIEF DESCRIPTION OF THE DRAWINGS

The preferred embodiments of the present invention are described in detail with reference to the drawings, in which.

DETAILED DESCRIPTION OF THE PREFERRED EMBODIMENTS

The first embodiment of the present invention will be described in detail with reference to FIG. 1 to FIG. 4 below.

Figure 1:
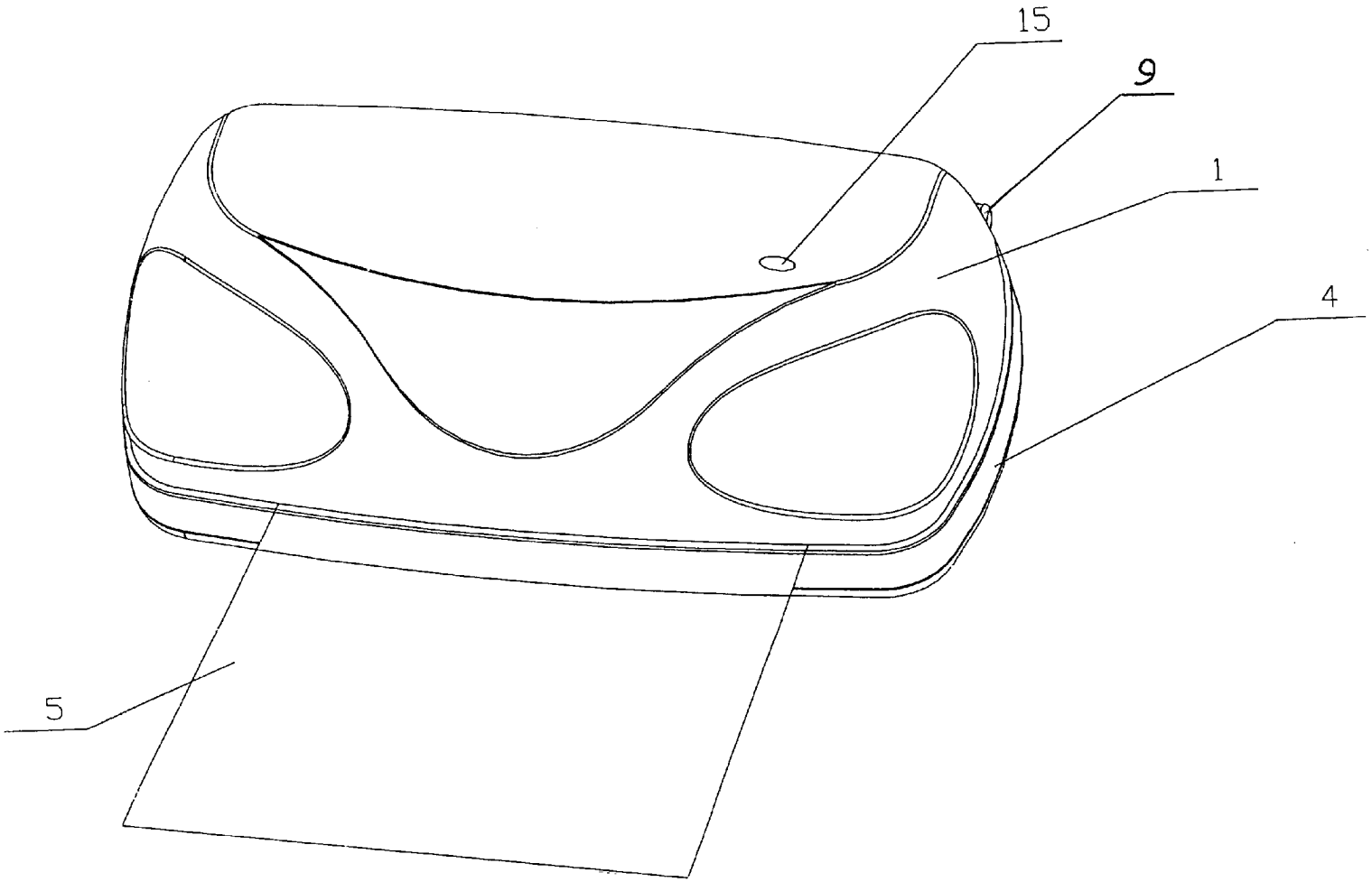
FIG. 1 is a view showing appearance of the vacuum bag sealing machine according to the present invention.
Figure 2:
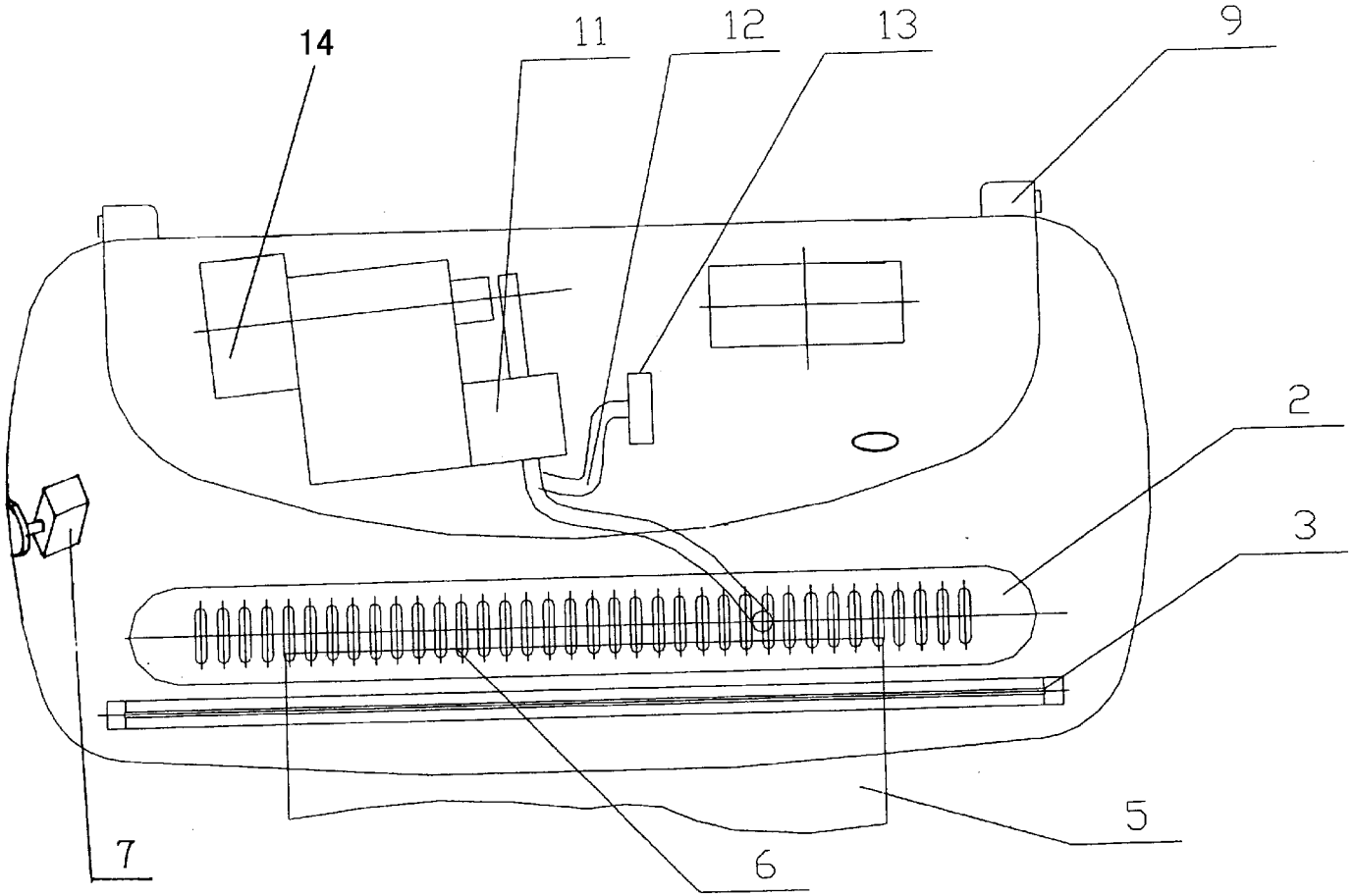
FIG. 2 is a schematic view showing the structure of the vacuum bag sealing machine according to the first embodiment of the present invention.

As shown in FIG. 2, the vacuum bag sealing machine according to the first embodiment of the present invention comprises a main body, a vacuum generating unit, a static sealing unit and a heating and opening-sealing unit.

Figure 4:
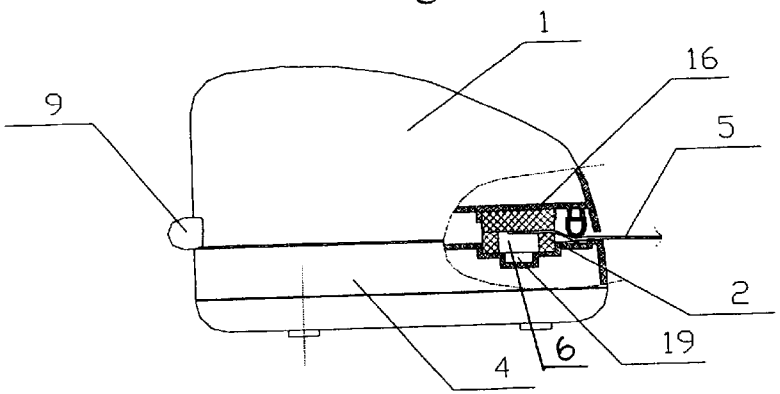
FIG. 4 is a lateral section view of the vacuum bag sealing machine shown in FIG. 2.

Referring to FIG. 4, the main body consists of a top cover 1 and a base 4 connected with the top cover 1 via a pivotal shaft 9.

Figure 3:
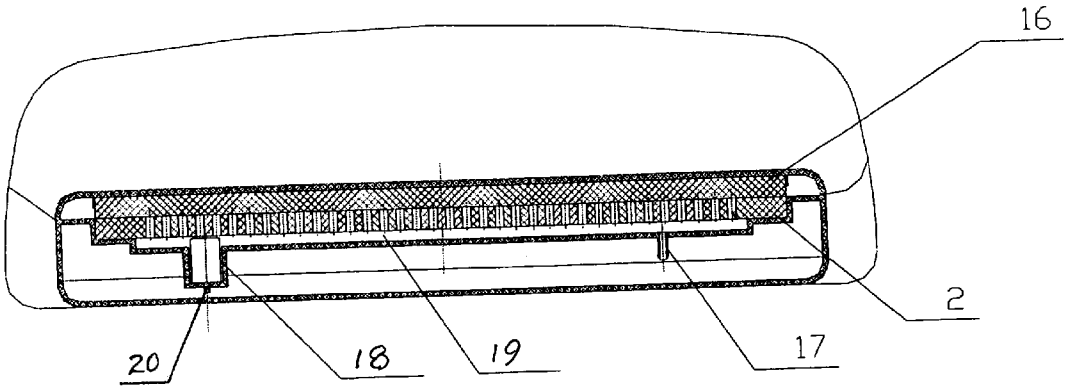
FIG. 3 is a longitudinal section view of the vacuum bag sealing machine shown in FIG. 2.

Referring to FIG. 3 and FIG. 4, the static sealing unit is positioned in the front of the main body, and includes an upper sealing strip 16 and a lower sealing strip 2, in which the upper sealing strip 16 is fixed in the top cover 1 and has a flat bottom surface, the lower sealing strip 2 is fixed on the base 4 at a position corresponding to the upper sealing strip 16, and has a flat top surface, a plurality of elongated through holes 6 are formed in the lower sealing strip 2, the plurality of elongated through holes 6 are arranged parallel to each other in the lower sealing strip 2 and extend perpendicularly with respect to the top surface of the lower sealing strip 2. An air guide groove 19 is formed in the base 4 under the bottom surface of the lower sealing strip 2, which is communicated with the plurality of elongated through holes 6 of the lower sealing strip 2. An exhaust tubule 17 is provided at one end of the bottom portion of the air guide groove 19, and an electromagnetic valve 18 is mounted at the other end thereof. An air guide pipe 20 is provided under the lower end of the electromagnetic valve 18 and engages with a corresponding hole in the base 4 so as to be communicated with ambient air.

Referring to FIG. 2 again, the exhaust tubule 17 and a pressure switch 13 are connected with an inlet end of the vacuum pump 11 via a rubber hose 12, the main body is provided with a start switch 7 used for starting the vacuum pump 11 driven by a motor 14. Heating wires 3 for sealing an opening of a plastic bag 5 are disposed on the base 4 outside the lower sealing strip 2.

Next, the operation of the vacuum bag sealing machine according to the first embodiment will be described. While using the vacuum bag sealing machine, the top cover 1 is opened and the open end of a plastic bag 5 is disposed at a position corresponding to the elongated though holes 6 of the lower sealing strip 2, but can not cover completely the openings of the through holes 6, then the top cover 1 is closed and pressed tightly. The open end of the plastic bag 5 is pressed tightly by the upper sealing strip 16 and the lower sealing strip 2, so that the interior of the plastic bag 5 is isolated from the ambient air. Subsequently, the start switch 7 of the vacuum pump 11 is turned on so as to operate the vacuum pump 11, at this time, the electromagnetic valve 18 is turned on and in a closed state. The air guide pipe 20 under the lower end of the electromagnetic valve 18 is blocked, so that the outside air can not enter into the air guide groove 19. Therefore, the air inside the plastic bag 5 converges at the inlet of the vacuum pump 11 through the elongated through holes 6, the air guide groove 19 and the exhaust tubule 17 sequentially, and is then discharged into the ambient air. When the pressure intensity inside the plastic bag 5 reaches −0.06 to −0.07 mpa, the pressure switch 13 is turned on and a heater circuit is switched on, so that the heating wires 3 is heated and an indicating lamp 15 is lighted at this time. After a predetermined time being elapsed, the opening of the plastic bag 5 is sealed, the indicating lamp 15 turns off and the electromagnetic valve 18 is switched off, so that the air guide pipe 20 under the lower end of the electromagnetic valve 18 is opened, the ambient air can enters into the air guide groove 19, in the mean while, the top cover 1 is opened and the plastic bag 5 which has been vacuumized and sealed is taken out.

The second embodiment of the present invention will be described with reference to FIG. 5 to FIG. 8 below. The second embodiment differs from the first embodiment in that the air guide groove 19 is instead of an air guide support 10 disposed between the upper and the lower sealing strips. It is noted that parts of the second embodiment similar to that of the first embodiment are denoted by the same reference numbers, and the detailed descriptions thereof are omitted.

Figure 5:
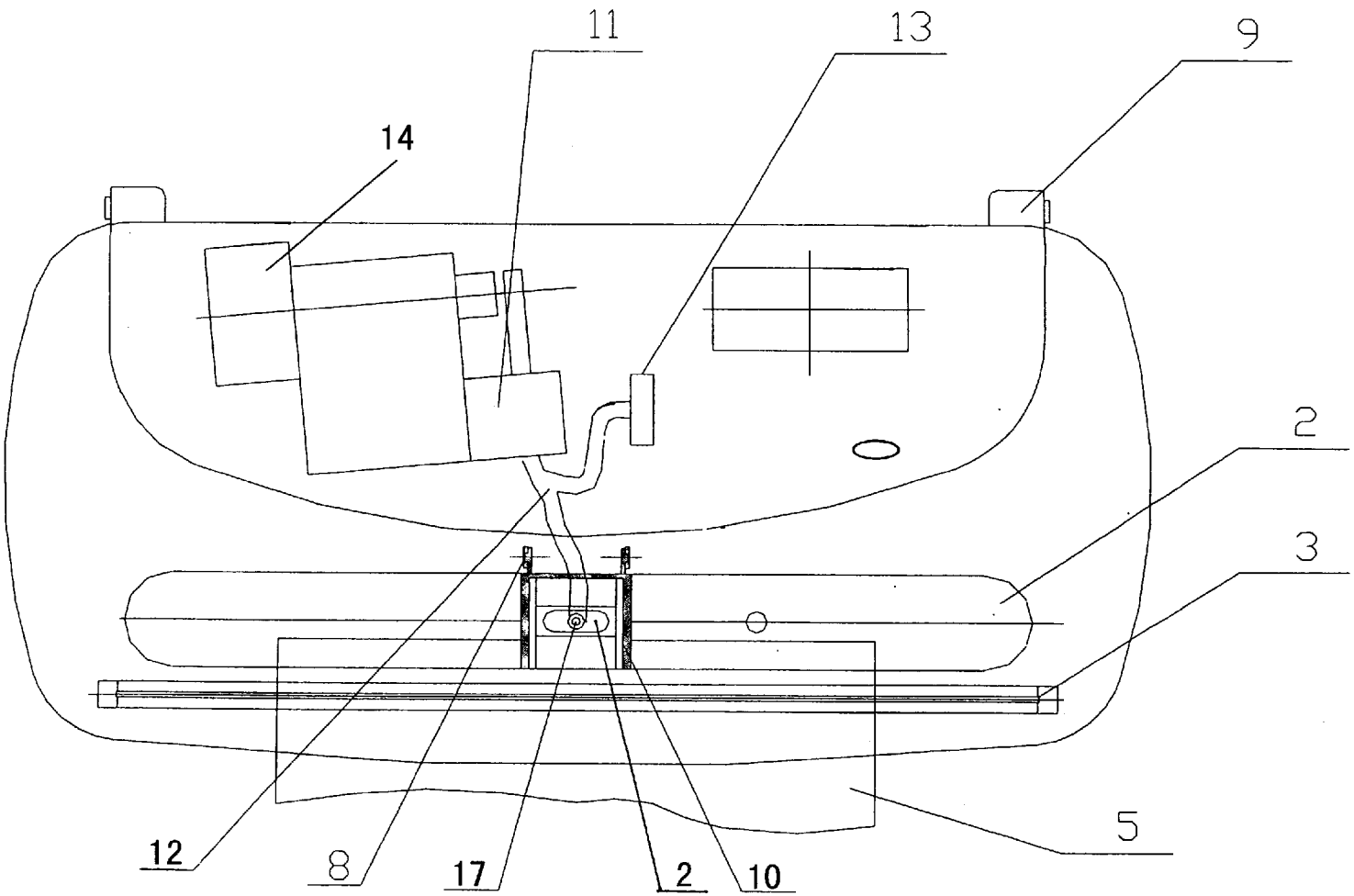
FIG. 5 is a schematic view showing the structure of the vacuum bag sealing machine according to the second embodiment of the present invention.

As shown in FIG. 5, the vacuum generating unit comprises a motor 14, an air guide support 10, an exhaust tubule 17, a vacuum pump 11 and a rubber hose 12. The air guide support 10 is disposed between an upper sealing strip 16 and a lower sealing stripe 2.

Figure 8:
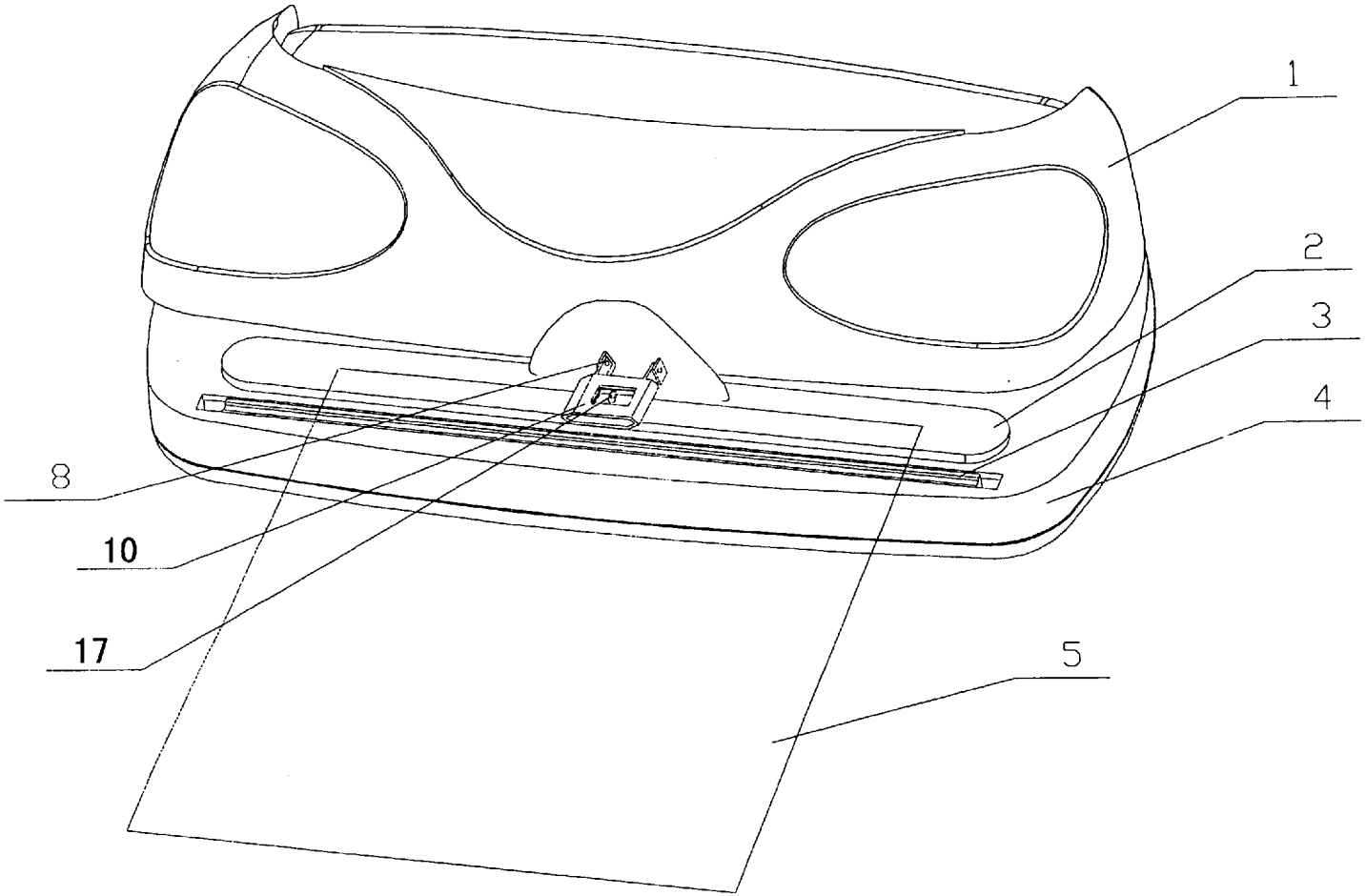
FIG. 8 is a schematic view showing the structure of the vacuum bag sealing machine shown in FIG. 5 with the vacuum generating unit being removed.

Referring to FIG. 5 and FIG. 8, the air guide support 10 is a flattened square barrel in shape, the air guide support 10 is connected to a mounting rack of the base 4 via a hinge 8 and can rotate around the hinge 8. An exhaust through hole 21 is formed in the central portion of the air guide support 10. The exhaust tubule 17 is mounted on the base 4 under the exhaust hole 21, the upper end face of the exhaust tubule 17 is higher than the surface of the base 4 therearound. Therefore, when pumping air, the dust and impurity contained in the air fall around the exhaust tubule 17 and can not enter the interior of the vacuum pump 17.

Figure 7:
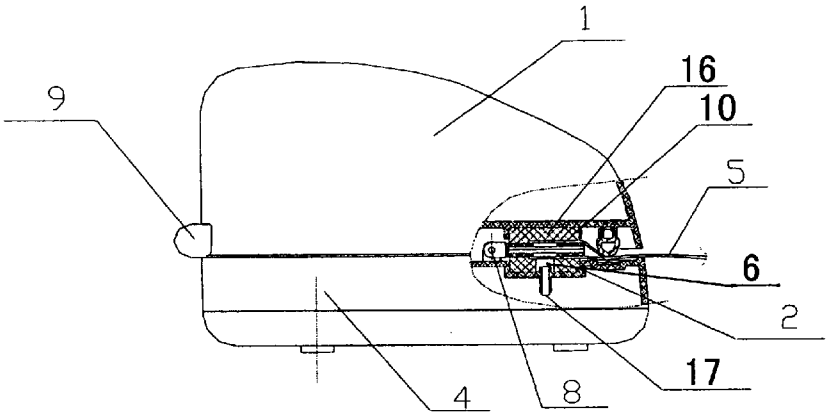
FIG. 7 is a lateral section view of the vacuum bag sealing machine shown in FIG. 5.
Figure 6:
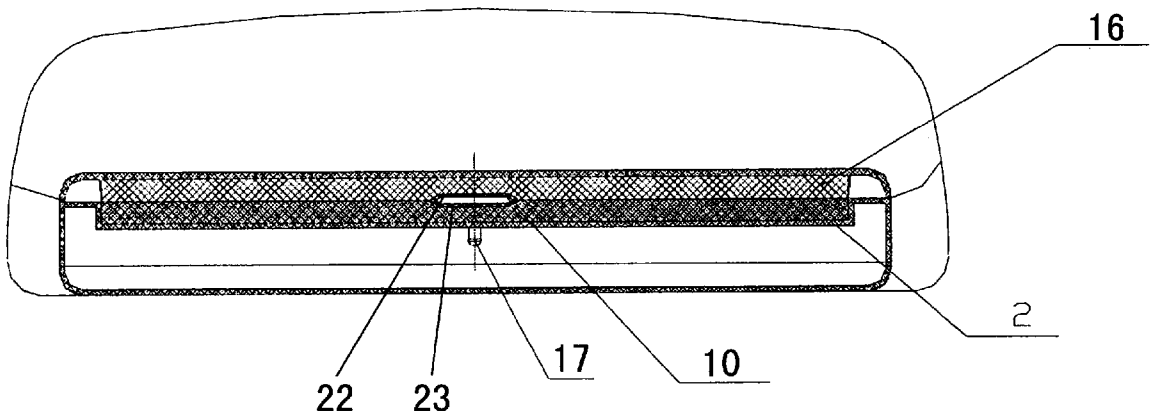
FIG. 6 is a longitudinal section view of the vacuum bag sealing machine shown in FIG. 5.

With reference to FIG. 6 and FIG. 7, the static sealing unit is positioned in the front of the main body and includes the upper sealing strip 16 and the lower sealing strip 2. The upper sealing strip 16 is fixed in the top cover 1 and has a first recess 22 provided in the bottom portion thereof, the profile of the first recess 22 is adaptive to that of the upper portion of the air guide support 10. The lower sealing strip 2 is fixed on the base 4 at a position corresponding to the upper sealing strip 16 and has a second recess 23 provided in the top portion thereof, the profile of the second recess 23 is adaptive to that of the lower portion of the air guide support 10. a through hole 6 is provided in the second recess 23 of the lower sealing strip 2 at a position corresponding to the exhaust hole 21 of the air guide support 10, the through hole 6 is communicated with the exhaust tubule 17 mounted on the base 4.

As shown in FIG. 5, the exhaust tubule 17 and a pressure switch 13 are connected with the inlet end of the vacuum pump 11 via the rubber hose 12. The heating wires 3 used for heating and sealing the opening of the plastic bag 5 are disposed on the base 4 outside the lower sealing strip 2.

Next, the operation of the vacuum bag sealing machine according to the second embodiment will be described in detail. While using the vacuum bag sealing machine according to the second embodiment, the open end portion of the plastic bag 5 slips over the front portion of the air guide support 10 but can not cover completely the exhaust hole 21, and the open end potion of the plastic bag 5 together with the air guide support 10 is disposed in the second recess 23 of the lower sealing strip 2. The top cover 1 is then closed, the upper sealing strip 16 presses against the open end portion of the plastic bag 5 and the upper portion of the air guide support 10 in the mean time, so that the interior of the plastic bag 5 is isolated from the ambient air. At the time of the top cover 1 being closed, the vacuum pump 11 driven by the motor 14 starts to operate, the air inside the plastic bag 5 is pumped out by the vacuum pump 11 through the air guide support 10, the exhaust hole 21, the through hole 6 and the exhaust tubule 17. When the pressure intensity inside the plastic bag 5 reaches −0.06 to −0.07 mpa, the pressure switch 13 is turned on and a heater circuit is switched on, so that the heating wires 3 is heated and the indicating lamp 15 is lighted simultaneously. After the open end of the plastic bag 5 is heated by the heating wires 3 and the opening thereof is sealed, the indicating lamp 15 turns off, then the top cover 1 is opened and the plastic bag 5 which has been vacuumized and sealed is taken out.

The preferred embodiments of the present invention are described with reference to the drawings. It is understood that the present invention is not limited to the above-described embodiments. A person skilled in the art may make various changes, modifications or substitutions to the preferred embodiments without departing from the scope of the present invention defined by the claims.

What is claimed is:

1. A vacuum bag sealing machine, comprising:

a main body consisted of a top cover and a base, said top cover and said base being connected with each other via a pivotal shaft;

a static sealing unit, including an upper sealing strip and a lower sealing strip which are disposed on the front portion or said main body, said lower seating strip being provided with a predetermined number of through holes;

a vacuum generating unit, including a vacuum pump and an exhaust tubule mounted on the base, said vacuum pump being communicated with said predetermined number of though holes formed in the lower sealing strip through said exhaust tubule; and a heating and opening sealing unit, wherein said static sealing unit comprises an upper sealing strip and a lower sealing strip; said vacuum generating unit comprises an air guide support positioned between said upper sealing strip and said lower sealing strip, the air guide support has an exhaust hole extended by being perpendicular to the top surface and the bottom surface thereof; said exhaust tubule connected with the vacuum pump is communicated with the exhaust hole via said through hole formed in said lower sealing strip; and, wherein said air guide support is a flattened barrel in shape and connected to a mounting rack on said base via a hinge, and can rotate around the hinge; said exhaust hole is formed in the central portion of said air guide support, and said exhaust tubule is mounted on said base under said exhaust hole.

2. The vacuum bag sealing machine of claim 1, wherein the upper end face of said exhaust tubule is higher than the surface of said base therearound.

3. The vacuum bag sealing machine of claim 1, wherein said upper sealing strip of said static sealing unit is fixed in said top cover, a first recess is provided in a bottom portion of said upper sealing strip, the profile of the first recess is adaptive to that of the upper portion of said air guide support; a second recess is provided in a top portion of said lower sealing strip, the profile of the second recess is adaptive to that of the lower portion of said air guide support; said through hole is formed in the second recess of said lower sealing strip at a position corresponding to said exhaust hole, and communicated with said exhaust tubule on the base.

4. The vacuum bag sealing machine of claim 1, wherein said exhaust tubule and a pressure switch are connected with an inlet end of said vacuum pump via a rubber hose.

5. The vacuum bag sealing machine of claim 1, wherein said heating and opening-sealing unit comprises heating wires disposed on said base outside said lower sealing strip.

* * * * *